US007610652B2

(12) United States Patent
Seo et al.

(10) Patent No.: US 7,610,652 B2
(45) Date of Patent: Nov. 3, 2009

(54) DUST RECEPTACLE HAVING ULTRAVIOLET (UV) TRANSMISSION WINDOW AND A VACUUM CLEANER HAVING THE SAME

(75) Inventors: Ji-won Seo, Gwangju (KR); Jang-Keun Oh, Gwangju (KR); Hak-bong Lee, JeollaNamdo (KR)

(73) Assignee: Samsung Gwangju Electronics Co., Ltd., Gwangu (KR)

( * ) Notice: Subject to any disclaimer, the term of this patent is extended or adjusted under 35 U.S.C. 154(b) by 723 days.

(21) Appl. No.: 11/227,668

(22) Filed: Sep. 15, 2005

(65) Prior Publication Data

US 2006/0185117 A1 Aug. 24, 2006

(30) Foreign Application Priority Data

Feb. 23, 2005 (KR) ..... 10-2005-0015071

(51) Int. Cl.
*A47L 9/00* (2006.01)

(52) U.S. Cl. ..... 15/347; 15/350; 15/352; 15/DIG. 8

(58) Field of Classification Search ..... 15/347, 15/350, 352, DIG. 8; *A47L 9/00, 9/10*
See application file for complete search history.

(56) References Cited

U.S. PATENT DOCUMENTS 6,193,894 B1 2/2001 Hollander ..... 210/748
6,296,775 B1 10/2001 Moody et al. ..... 210/748
6,968,595 B2 * 11/2005 Oh et al. ..... 15/339
2005/0091785 A1 * 5/2005 Yuen ..... 15/350

FOREIGN PATENT DOCUMENTS

| | | |
|---|---|---|
| CN | 1462605 | 12/2003 |
| DE | 2232519 | 11/1973 |
| DE | 19830020 | 8/1999 |
| GB | 648967 | 1/1951 |
| KR | 1998-063387 | 11/1998 |
| KR | 100232536 | 6/1999 |

OTHER PUBLICATIONS

Office Action issued on Feb. 9, 2007 from the Chinese Patent Office with respect to Chinese Patent Application No. 200510108296.X.
Office Action issued on Dec. 25, 2006 from the Russian Patent Office with respect to Russian Patent Application No. 2005131298.

* cited by examiner

*Primary Examiner*—David A Redding
(74) *Attorney, Agent, or Firm*—Ohlandt, Greeley, Ruggiero & Perle, L.L.P.

(57) ABSTRACT

A dust receptacle comprising an ultraviolet transmission window and a vacuum cleaner having the same. The dust receptacle includes a receptacle body detachably mounted to a cleaner body, an ultraviolet (UV) transmission window penetratingly formed on the receptacle body, and a Teflon® cover sealing the UV transmission window. The vacuum cleaner having the dust receptacle includes a cleaner body, a dust receptacle detachably mounted to the cleaner body, a UV sterilizer lamp mounted within the cleaner body to scan the dust receptacle with a UV ray, a grill protecting the UV sterilizer lamp. In the vacuum cleaner, the dust receptacle has the same structure as described above.

5 Claims, 4 Drawing Sheets

DUST RECEPTACLE HAVING ULTRAVIOLET (UV) TRANSMISSION WINDOW AND A VACUUM CLEANER HAVING THE SAME

CROSS-REFERENCE TO RELATED APPLICATIONS

This application claims benefit under 35 U.S.C. § 119(a) of Korean Patent Application No. 2005-15071, filed Feb. 23, 2005, the entire contents of which are incorporated herein by reference.

BACKGROUND OF THE INVENTION

1. Field of the Invention

The present invention relates to a vacuum cleaner. More particularly, the present invention relates to a dust receptacle for a vacuum cleaner, which has an ultraviolet (UV) sterilizer lamp for disinfecting the dust receptacle collecting therein impurities, and a vacuum cleaner having the same.

2. Description of the Related Art

Generally, a vacuum cleaner collects dust on a surface being cleaned by drawing in ambient air, using a negative pressure generated by a vacuum suction means mounted in a cleaner body. With the booming of well-being and healthy life, recently, a vacuum cleaner having an ultraviolet (UV) sterilizer lamp provided to the cleaner body has been introduced in order to remove germs which may exist in the dust collected in a dust receptacle as well as merely collect the dust.

As a related art, Korean Patent Registration No. 10-0232536 discloses a vacuum cleaner in which a UV sterilizer lamp for killing worms or ticks in a dust bag and a transparent quartz glass board is mounted on the front of a UV sterilizer lamp mounting portion to protect the UV sterilizer lamp from foreign substances.

However, when the UV sterilizer lamp is mounted directly inside a dust-collecting space such as the dust bag, although the quarts glass board shields the UV sterilizer lamp from the foreign substances, the quarts glass board itself may be easily contaminated by the collected dust. In this case, a UV ray generated by the UV sterilizer lamp could not be thoroughly transmitted into the dust bag, thereby deteriorating a sterilizing efficiency. Also, being always exposed to the dust, the quartz glass board shielding the UV sterilizer lamp may be damaged by large dust.

SUMMARY OF THE INVENTION

An aspect of the present invention is to solve at least the above problems and/or disadvantages and to provide at least the advantages described below. Accordingly, an aspect of the present invention is to provide an improved dust receptacle for a vacuum cleaner, capable of preventing contamination and damage of an ultraviolet (UV) sterilizer lamp by collected dust and enhancing sterilizing efficiency of the inside thereof, and a vacuum cleaner having the same.

In order to achieve the above-described aspects of the present invention, there is provided a dust receptacle for a vacuum cleaner, comprising a receptacle body detachably mounted to a cleaner body, an ultraviolet (UV) transmission window penetratingly formed on the receptacle body, and a polytetrafluoroethylene-containing cover sealing the UV transmission window.

A plurality of connection protrusions are formed around the UV transmission window, and a plurality of connection holes are formed corresponding to the connection protrusions on the polytetrafluoroethylene-containing cover.

The connection protrusions are arranged in at least two rows and formed of a polygonal column so that the connection protrusions in one row face those in another row in an alternate manner.

An end of the connection protrusions as penetrating the connection holes are fixed by compression with high temperature and high pressure.

The UV transmission window has a recessed portion slanted by a predetermined angle toward an upper portion of the dust receptacle.

The polytetrafluoroethylene-containing cover is formed of a transparent material.

According to another aspect of the present invention, there is provided a vacuum cleaner comprising a cleaner body; a dust receptacle detachably mounted to the cleaner body; a UV sterilizer lamp mounted within the cleaner body to scan the dust receptacle with a UV ray; a grill protecting the UV sterilizer lamp, wherein the dust receptacle comprises, a UV transmission window formed on a position directing the UV sterilizer lamp, and a polytetrafluoroethylene-containing cover sealing the UV transmission window.

The UV sterilizer lamp and the grill are slanted by a predetermined angle with respect to a length direction of the dust receptacle.

BRIEF DESCRIPTION OF THE DRAWING FIGURES

The above aspect and other features of the present invention will become more apparent by describing in detail exemplary embodiments thereof with reference to the attached drawing figures, wherein.

DETAILED DESCRIPTION OF THE EXEMPLARY EMBODIMENTS

Figure 1:
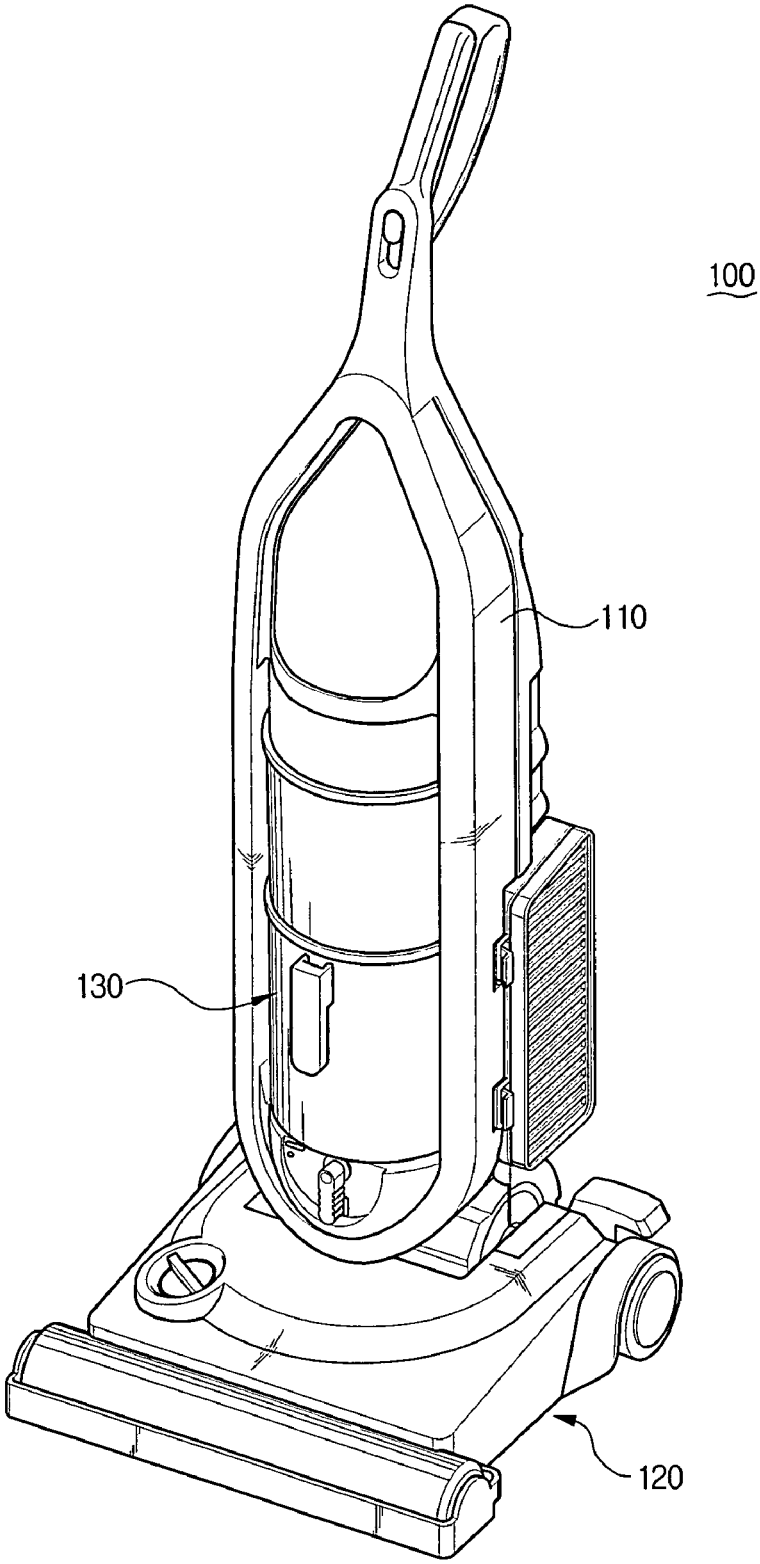
FIG. 1 is a perspective view of a vacuum cleaner according to an embodiment of the present invention.

Hereinafter, a dust receptacle of a vacuum cleaner and a vacuum cleaner having the same according to certain embodiments of the present invention will be described in detail with reference to the accompanying drawing figures.

In the following description, same drawing reference numerals are used for the same elements even in different drawings. The matters defined in the description such as a detailed construction and elements are nothing but the ones provided to assist in a comprehensive understanding of the invention. Thus, it is apparent that the present invention can be carried out without those defined matters. Also, well-known functions or constructions are not described in detail since they would obscure the invention in unnecessary detail.

Referring to FIG. 1, a vacuum cleaner 100 according to an embodiment of the present invention comprises a cleaner body 110, a suction brush 120 and a dust receptacle 130.

Figure 2:
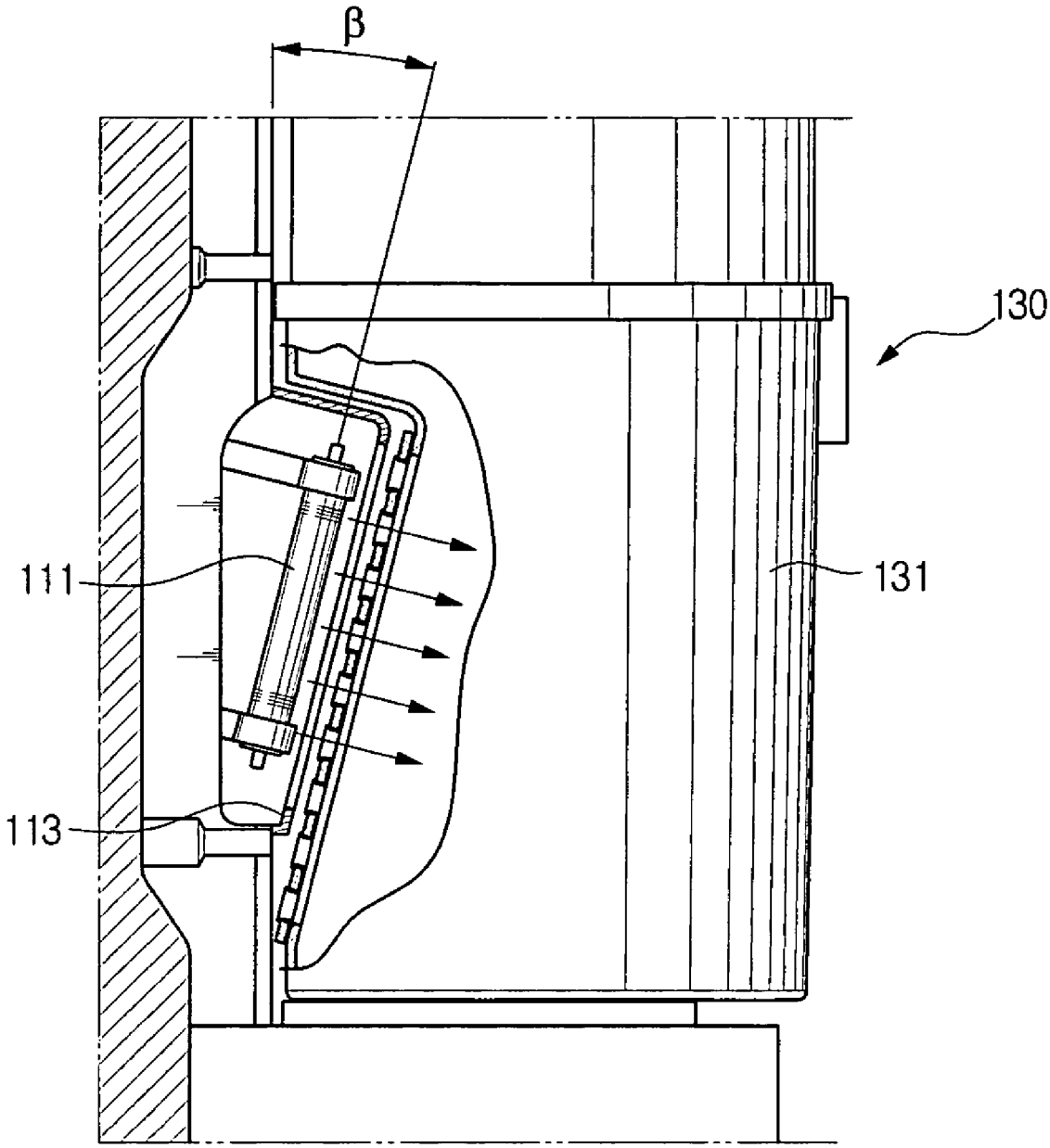
FIG. 2 is an enlarged, sectional view of an ultraviolet (UV) sterilizer lamp and a dust receptacle of FIG. 1.
Figure 3:
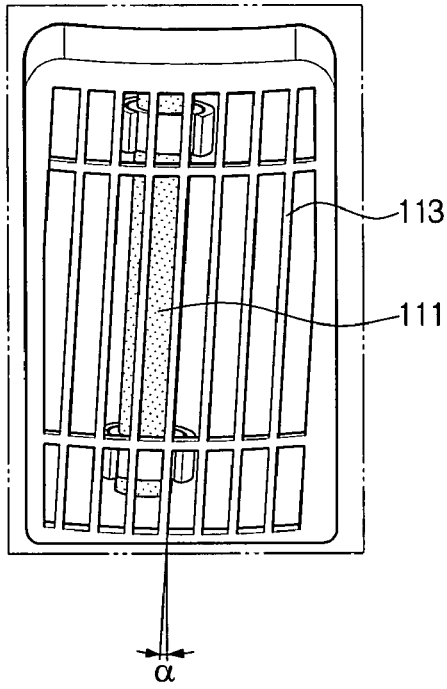
FIG. 3 is a view showing the UV sterilizer lamp of FIG. 2.
Figure 4:
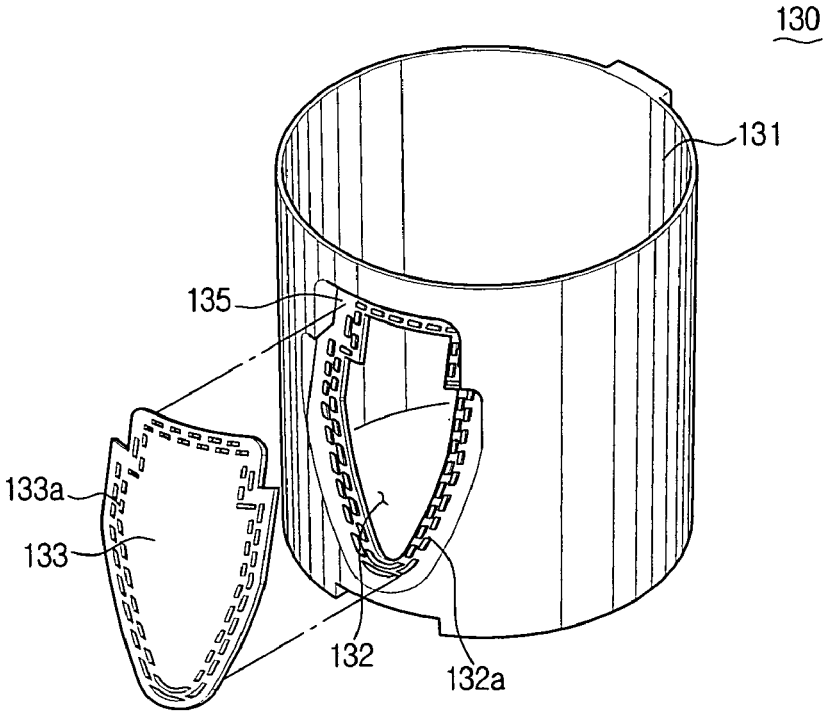
FIG. 4 is a perspective view of a dust receptacle according to an embodiment of the present invention.

The cleaner body 110 includes a vacuum suction means (not shown) and a dust collecting unit (not shown) for separating dust from dust-laden air which is drawn in by a suction brush 120. As shown in FIG. 2, the cleaner body 110 directing the dust receptacle 130 includes therein an ultraviolet (UV) sterilizer lamp 111 for removing germs and a grill 113 for protecting the UV sterilizer lamp 111. As shown in FIG. 4, the UV sterilizer lamp 111 and the grill 113 are slantingly mounted by a predetermined angle α with respect to a length direction of the dust receptacle 130. Preferably, the angle α is approximately 15°. The reason of slanting the UV sterilizer lamp 111 and the grill 113 is to evenly apply the UV ray projected from the UV sterilizer lamp 111 onto the inside of the dust receptacle 130.

As shown in FIGS. 2 and 4, the dust receptacle 130 comprises a receptacle body 131, a UV transmission window 132 and a polytetrafluoroethylene-containing cover 133.

The receptacle body 131 has an open top portion for inflow of the dust separated by the dust collecting unit (not shown). The receptacle body 131 collects the separated dust in a space formed therein.

The UV transmission window 132 is penetratingly formed at a position corresponding to the UV sterilizer lamp 111 on the receptacle body 131. The UV transmission window 132 has a recessed portion 135 (FIG. 4) slanted toward the upper portion of the dust receptacle 130 by a predetermined angle β. Preferably, the predetermined angle β is approximately 10°. The reason of disposing the UV transmission window 132 to be recessed into the receptacle body 131 is to minimize a projection distance of the UV ray projected from the UV sterilizer lamp 111. In other words, by recessing the UV transmission window 132 toward the inside of the dust receptacle 130, the UV ray generated by the UV sterilizer lamp 111 can be approximated as much as possible to a bottom or an inner wall of the dust receptacle 130. This may bring the same effect as when the UV sterilizer lamp 111 is mounted within the dust receptacle 130. That is, a stronger UV ray can be scattered into the dust receptacle 130 by reducing the projection distance of the UV ray, thereby reinforcing the sterilizing efficiency.

The polytetrafluoroethylene-containing cover 133 seals the UV transmission window 132 so as to maintain airtightness inside the dust receptacle 130. Since the polytetrafluoroethylene-containing seldom has an affinity for other substances, impurities such as dust do not easily attach thereon. Therefore, being formed of Teflon® material, the polytetrafluoroethylene-containing cover 133 can be kept clean. Also, due to superior UV transmittance, the polytetrafluoroethylene-containing cover 133 is able to transmit the UV ray projected from the UV sterilizer lamp 111 into the dust receptacle 130. However, due to the aforementioned character of polytetrafluoroethylene-containing, the polytetrafluoroethylene-containing cover 133 cannot be formed integrally with the dust receptacle 130 made of general resin nor attached through general method such as bonding with adhesive.

Hereinafter, a connection method of the polytetrafluoroethylene-containing cover 133 will be described with reference to the accompanying drawings.

As shown in FIG. 4, a plurality of connection protrusions 132*a* are formed around the UV transmission window 132 whereas a plurality of connection holes 133*a* are formed corresponding to the connection protrusions 132*a* on the polytetrafluoroethylene-containing cover 133. The connection protrusions 132*a* are arranged in at least two rows and formed as a polygonal pillar, respectively. Furthermore, the connection protrusions 132*a* in one row face those in another row in an alternate manner. Therefore, as shown in FIG. 5, the polytetrafluoroethylene-containing cover 133 can be tightly connected with the UV transmission window 132, being engaged with the plurality of connection protrusions 132*a*.

Figure 5:
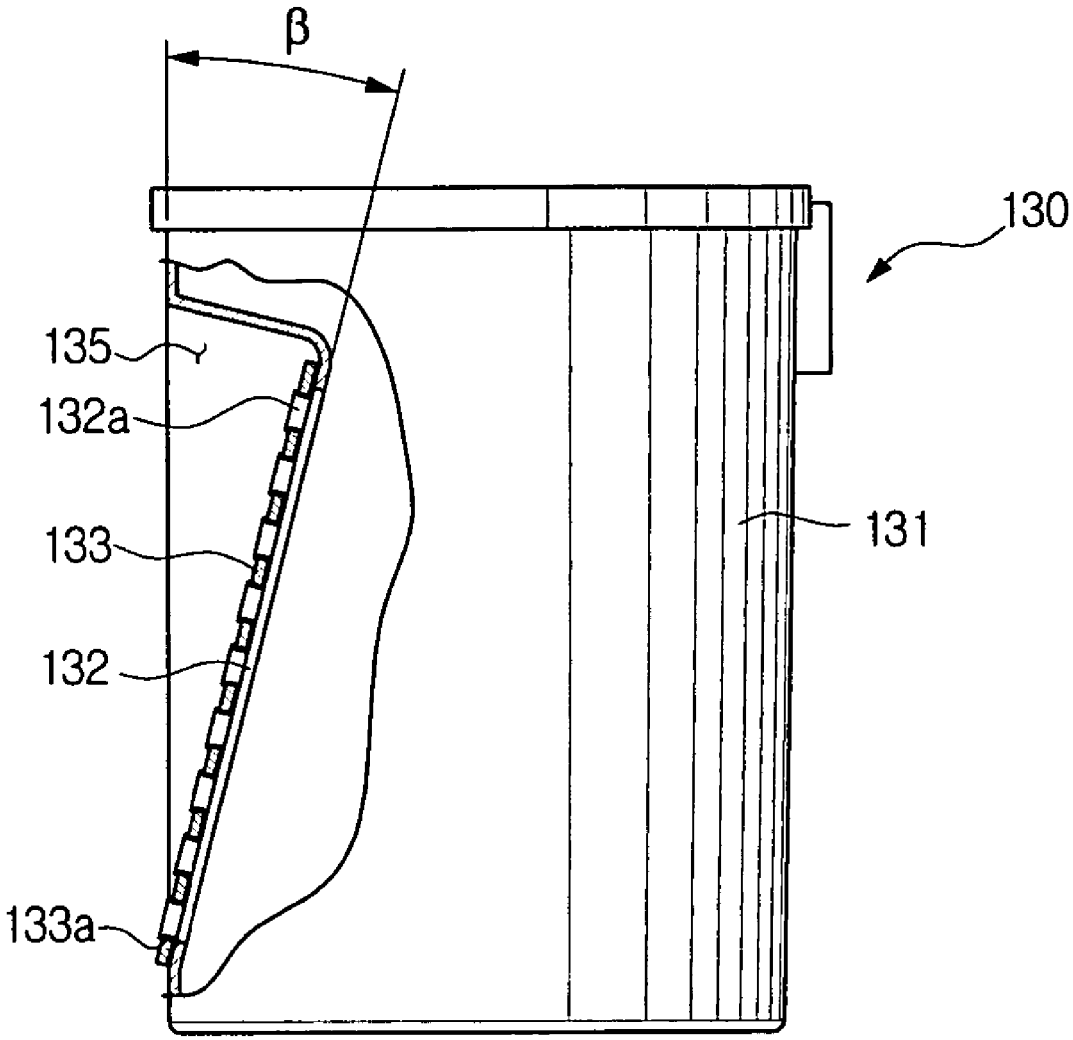
FIG. 5 is a sectional view showing the connection structure of a polytetrafluoroethylene-containing cover.

As shown in the sectional view of FIG. 5, an end of the connection protrusion 132*a* as penetrating the connection holes 133*a* is transformed by high temperature and high pressure, thereby fixing the polytetrafluoroethylene-containing cover 133 as mounted. When the plurality of connection protrusions 132*a* are alternately arranged with respect to the rows, as described above, the respective faces of the connection protrusions 132*a* can act as walls blocking intervals between the connection protrusions 132*a*. Therefore, airtightness of the dust receptacle 130 is guaranteed without having to provide a dedicated sealing member such as a gasket.

The polytetrafluoroethylene-containing cover 133 does not have to be transparent to transmit the UV ray since its UV transmittance is superior; however, it is preferable to form the polytetrafluoroethylene-containing cover 133 of a transparent material so that a user can observe the inside of the dust receptacle 130 with the unaided eye.

As described above, by mounting the UV sterilizer lamp 111 within the cleaner body 110 separated from the dust receptacle 130, airtightness of the dust receptacle 130 can be maintained and in addition, contamination and damage of the UV sterilizer lamp 111 by the collected dust can be prevented.

Moreover, because the polytetrafluoroethylene-containing cover 133 is not easily contaminated by dust, the UV ray projected to the dust receptacle 130 can be stably maintained.

Although an upright-type vacuum cleaner has been taken as an example in describing an embodiment of the present invention, the present invention is not limited so but applicable to other types of vacuum cleaner having a dust receptacle, such as a canister-type vacuum cleaner.

As can be appreciated from the above description, since the UV sterilizer lamp 111 is mounted outside the dust receptacle 130, contamination and damage of the UV sterilizer lamp 111 by the dust being collected can be prevented.

Additionally, because the dust receptacle 130 is sealingly mounted to the cleaner body 110, loss of pressure and leakage of the dust, which may occur when the UV sterilizer lamp 111 is mounted in the dust receptacle 130, can be prevented.

While the invention has been shown and described with reference to certain embodiments thereof, it will be understood by those skilled in the art that various changes in form and details may be made therein without departing from the spirit and scope of the invention as defined by the appended claims.

What is claimed is:

1. A dust receptacle for a vacuum cleaner, comprising:

a receptacle body detachably mounted to a cleaner body;

an ultraviolet (UV) transmission window penetratingly formed on the receptacle body;

a polytetrafluoroethylene-containing cover sealing the UV transmission window;

a plurality of connection protrusions formed around the UV transmission window; and a plurality of connection holes formed on the polytetrafluoroethylene-containing cover, wherein the plurality of connection holes correspond to the plurality of connection protrusions, and wherein the plurality of connection protrusions are arranged in at least two rows and formed of a polygonal column so that the plurality of connection protrusions in one row face those in another row in an alternate manner.

2. The dust receptacle of claim 1, further comprising a sealing portion which is fixed by compressing an end of the connection protrusions as penetrating the connection holes with high temperature and high pressure.

3. The dust receptacle of claim 1, wherein the UV transmission window has a recessed portion slanted by a predetermined angle toward an upper portion of the dust receptacle.

4. The dust receptacle of claim 1, wherein the polytetrafluoroethylene-containing cover is formed of a transparent material.

5. A vacuum cleaner comprising:

a cleaner body;

a dust receptacle detachably mounted to the cleaner body;

a UV sterilizer lamp mounted within the cleaner body to scan the dust receptacle with a UV ray; and a grill protecting the UV sterilizer lamp, wherein the dust receptacle comprises a UV transmission window formed on a position directing the UV sterilizer lamp, and a polytetrafluoroethylene-containing cover sealing the UV transmission window, wherein the UV sterilizer lamp and the grill are slanted by a predetermined angle with respect to a length direction of the dust receptacle.

* * * * *